US011945614B2

(12) United States Patent
Kuchinski et al.

(10) Patent No.: US 11,945,614 B2
(45) Date of Patent: Apr. 2, 2024

(54) SEALANT CARTRIDGE AIR RELEASE APPARATUS AND METHODS

(71) Applicant: PRC-DESOTO International, Inc., Sylmar, CA (US)

(72) Inventors: Paul Kuchinski, Valley Village, CA (US); Ralph Roppo, Snohomish, WA (US); Oscar Santillan, Camarillo, CA (US)

(73) Assignee: PRC-DESOTO INTERNATIONAL, INC., Sylmar, CA (US)

( * ) Notice: Subject to any disclaimer, the term of this patent is extended or adjusted under 35 U.S.C. 154(b) by 323 days.

(21) Appl. No.: 17/609,432

(22) PCT Filed: May 7, 2020

(86) PCT No.: PCT/US2020/031872

§ 371 (c)(1),
(2) Date: Nov. 8, 2021

(87) PCT Pub. No.: WO2020/227529

PCT Pub. Date: Nov. 12, 2020

(65) Prior Publication Data

US 2022/0219844 A1 Jul. 14, 2022

Related U.S. Application Data

(60) Provisional application No. 62/844,950, filed on May 8, 2019.

(51) Int. Cl.
*B65B 3/10* (2006.01)
*B65B 3/18* (2006.01)

(52) U.S. Cl.
CPC . *B65B 3/18* (2013.01); *B65B 3/10* (2013.01)

(58) Field of Classification Search
CPC ..... B65B 3/10; B65B 3/18
(Continued)

(56) References Cited

U.S. PATENT DOCUMENTS 4,926,613 A * 5/1990 Hansen ..... B67C 3/223 53/433
7,744,365 B2 * 6/2010 Maddox ..... B29C 49/4802 425/522

(Continued)

FOREIGN PATENT DOCUMENTS

DE 102010004068 A1 7/2011
EP 0362552 A1 4/1990

(Continued)

OTHER PUBLICATIONS

International Search Report and Written Opinion received for PCT Application Serial No. PCT/US2020/031872 dated Sep. 17, 2020, 10 pages.

*Primary Examiner* — Gloria R Weeks
(74) *Attorney, Agent, or Firm* — Alan G. Towner

(57) ABSTRACT

Sealant cartridge press fixtures are disclosed. The fixtures include a bracket comprising first and second side arms that receive a sealant cartridge therebetween. A transverse support bar connected to the first and second side arm is attached to a sealant filling nozzle. An air pressure cylinder mounted on the bracket includes a reciprocating piston rod that contacts and deforms a sidewall of the sealant cartridge at the beginning of a filling operation to allow trapped air to escape from the cartridge. An empty sealant cartridge having a slidable plunger therein is mounted at its front end on the sealant filling nozzle. The sealant is initially dispensed into the cartridge in the space between the front end of the cartridge and the plunger. While pressing and deforming the sidewall, it temporarily creates a gap between an interior (Continued)

surface of the sidewall and a plunger. The gap allows unwanted trapped air to escape from the sealant cartridge.

24 Claims, 7 Drawing Sheets

(58) Field of Classification Search
USPC ..... 53/86, 470, 266.1
See application file for complete search history.

(56) References Cited

U.S. PATENT DOCUMENTS

| | | | | |
|---|---|---|---|---|
| 8,479,779 | B2 * | 7/2013 | Behar | B65B 3/16 141/285 |
| 9,302,794 | B2 * | 4/2016 | Hansen | B65B 3/18 |
| 9,943,654 | B2 * | 4/2018 | Herrmann | A61M 11/02 |
| 2011/0253252 | A1 * | 10/2011 | Buchanan | B60T 17/222 141/69 |
| 2020/0108533 | A1 * | 4/2020 | Schulz | B65B 3/18 |
| 2022/0396380 | A1 * | 12/2022 | Kil | B67B 7/182 |
| 2023/0339630 | A1 * | 10/2023 | Emura | B65B 3/003 |

FOREIGN PATENT DOCUMENTS

| | | | |
|---|---|---|---|
| EP | 1052216 | A1 | 11/2000 |
| EP | 2934851 | A1 | 10/2015 |
| EP | 3187269 | A1 | 7/2017 |
| FR | 3050439 | A1 | 10/2017 |

* cited by examiner

SEALANT CARTRIDGE AIR RELEASE APPARATUS AND METHODS

CROSS-REFERENCE TO RELATED APPLICATION

This application claims the benefit of U.S. Provisional Patent Application Ser. No. 62/844,950 filed on May 8, 2019, which is incorporated herein by reference.

FIELD OF THE INVENTION

The present invention relates to sealant cartridge air release apparatus and methods.

BACKGROUND OF THE INVENTION

When sealant cartridges are being filled with sealant formulations such as pre-mixed and frozen (PMF) sealants, pockets of air can be trapped between the cartridge plunger and the sealant filling the cartridge. Air bubbles in the sealant cause problems during dispensing by popping out and causing disruptions in the sealant bead formed on the application surface.

SUMMARY OF THE INVENTION

The present invention provides a sealant cartridge press fixture comprising: a bracket comprising a first side arm and a second side arm structured and arranged to receive a sealant cartridge therebetween, and a transverse support bar connected to the first and second side arms structured and arranged for attachment to a sealant filling nozzle. An air pressure cylinder mounted on the bracket comprises a reciprocating piston rod structured and arranged to contact and deform a sidewall of the sealant cartridge when the piston rod is extended from the air pressure cylinder.

The present invention also provides a method of releasing trapped air from a sealant cartridge. The method comprises mounting an empty sealant cartridge on a sealant filling nozzle, starting filling of the sealant cartridge with a sealant, pressing a sidewall of the sealant cartridge to temporarily deform the sidewall to create a gap between an interior surface of the sidewall and a plunger contained within the sealant cartridge in slidable contact with the interior surface wherein the gap allows trapped air to escape from a sealant filling region of the sealant cartridge, stopping the pressing of the sidewall, and continuing to fill the sealant cartridge with the sealant.

DETAILED DESCRIPTION OF THE INVENTION

Figure 1:
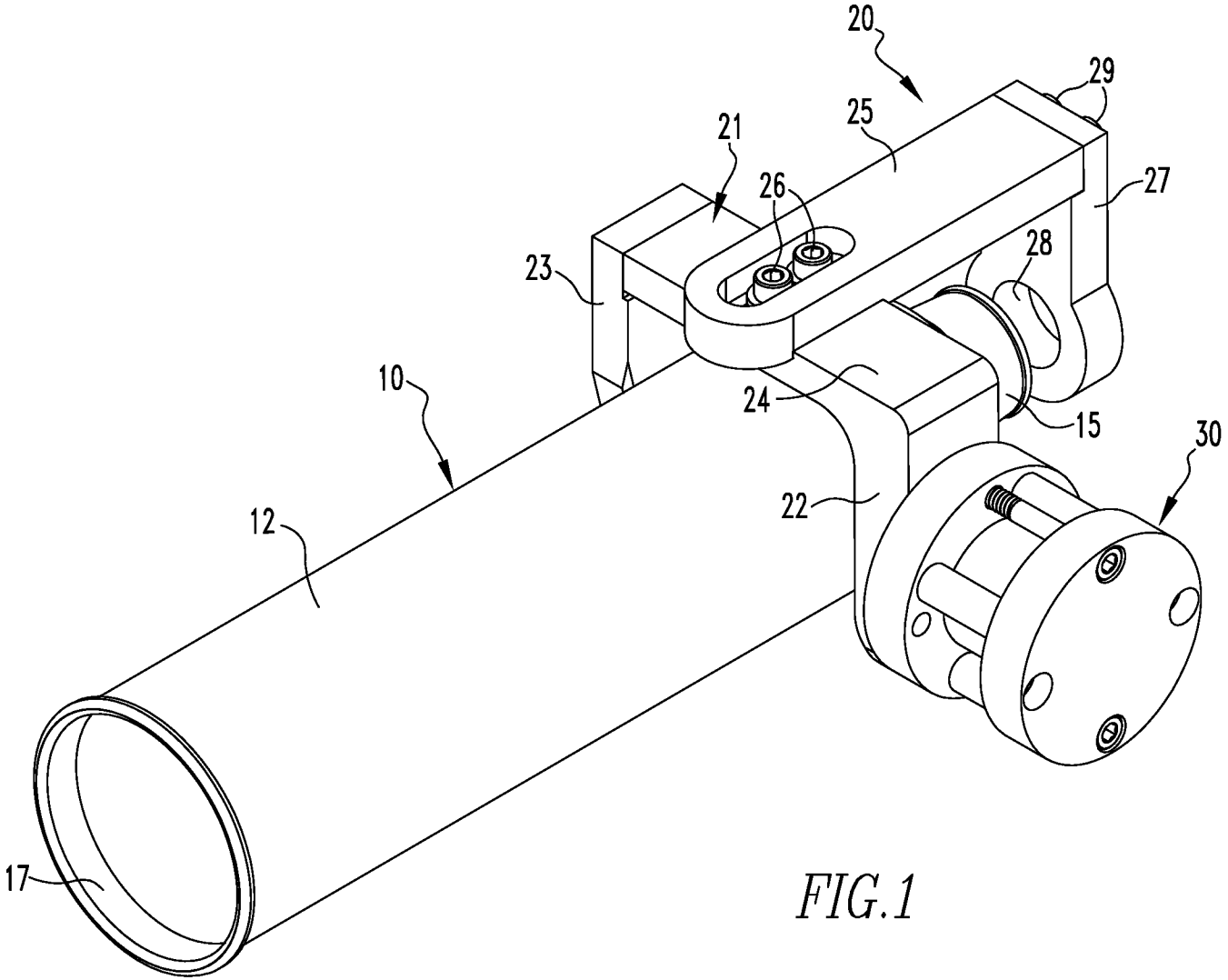
FIG. 1 is an isometric view of a sealant cartridge and press fixture of the invention.
Figure 2:
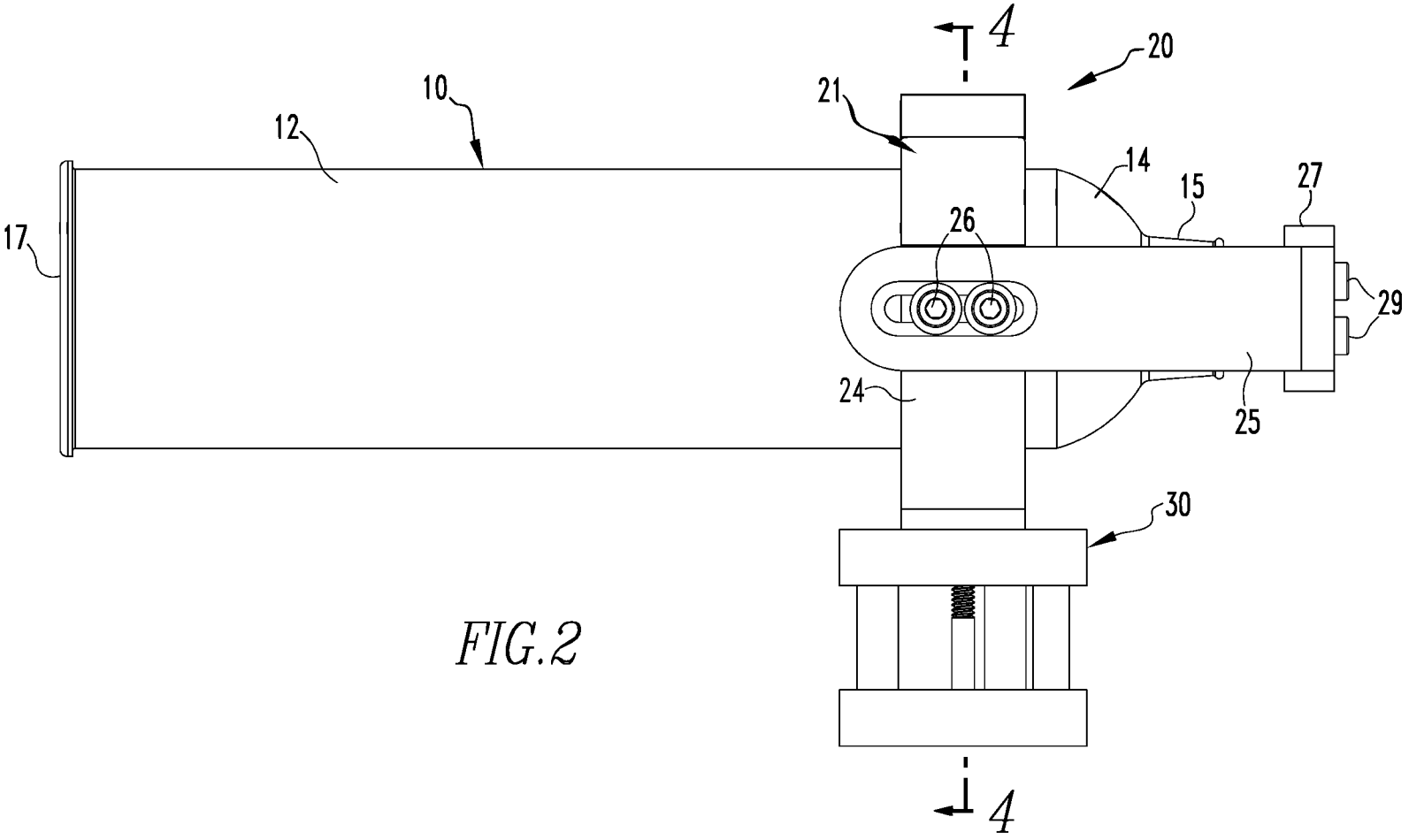
FIG. 2 is a rear view of the sealant cartridge and press fixture of FIG. 1.

FIGS. 1-4 illustrate a sealant cartridge 10 mounted in a press fixture 20 of the present invention. The sealant cartridge 10 includes a generally cylindrical sidewall 12, a domed lower end 14 with a discharge opening 15 through which the cartridge 10 may be filled with sealant and through which the sealant may be subsequently discharged from the cartridge 10. The discharge opening 15 may be interiorly threaded 16 for connection to a sealant dispensing tip during use. The sealant cartridge 10 includes an open upper end 17 through which a plunger 18 may be inserted in the sealant cartridge 10 and positioned at or near the domed lower end 14 prior to filling of the sealant cartridge 10 with sealant. The plunger 18 includes a side wiper edge 19 in contact with an interior surface of the sidewall 12 of the sealant cartridge 10. The volume inside the cartridge 10 between the domed lower end 14 and plunger 18 defines a sealant volume inside the cartridge 10 that may contain air to be released from the sealant volume by a press fixture of the present invention. As more fully described below, the adhesive and sealant compositions may comprise any formulations known to those skilled in the art.

As shown in FIGS. 1-7, the press fixture 20 includes a bracket 21 having a first side arm 22, second side arm 23 and a cross bar 24 connecting the first and second side arms. A longitudinal support bar 25 is fastened to the cross bar 24 by mounting bolts 26. A transverse support bar 27 is attached to the longitudinal support bar 25 by mounting bolts 29. A circular central opening 28 is provided through the transverse support bar 27.

An air pressure cylinder 30 is secured to the first side arm 22 of the bracket 21. As shown most clearly in FIGS. 3 and 4, the air pressure cylinder 30 includes a pressure chamber 31 in flow communication with a pressurized air inlet 32. A piston 33 with a piston rod 34 is reciprocally mounted in the air pressure cylinder 30. When pressurized air P is fed through the pressurized air inlet 32 into the pressure chamber 31, the piston 33 and piston rod 34 are forced outwardly from the pressure chamber 31. A pressure pad 35 mounted on the end of the piston rod 34 contacts the sidewall 12 of the sealant cartridge 10 as a result of the air pressure delivered to the pressure chamber 31. The force applied by the piston rod 34 and pressure pad 35 against the sidewall 12 of the sealant cartridge 10 causes controlled deformation of the sidewall 12. Air bubbles formed between the cartridge plunger 18 and sealant when the sealant cartridge is being filled may be removed by squeezing the cartridge sidewall 12 in a region near the plunger 18 at a selected moment during the filling process. The trapped air is therefore allowed to escape. The deformation creates an air gap between the interior surface of the sidewall 12 and the side wiper edge 19 of the plunger 18. The temporary air gap allows air that may be trapped inside the sealant cartridge 10 between the plunger 18 and domed end 14 to escape pass the side wiper edge 19 of the plunger 18 toward the open end 17. When the piston rod 34 and pressure pad 35 are pressed against the sidewall 12 of the sealant cartridge 10, the radial opposite side of the sidewall 12 may contact and press against a stationary pressure pad 38 mounted on the second side arm 23 of the bracket 21. As shown most clearly in FIG. 4, the stationary pressure pad 38 may be partially inserted in a mounting hole 39 extending through the second side arm 23 of the bracket 21.

Figure 3:
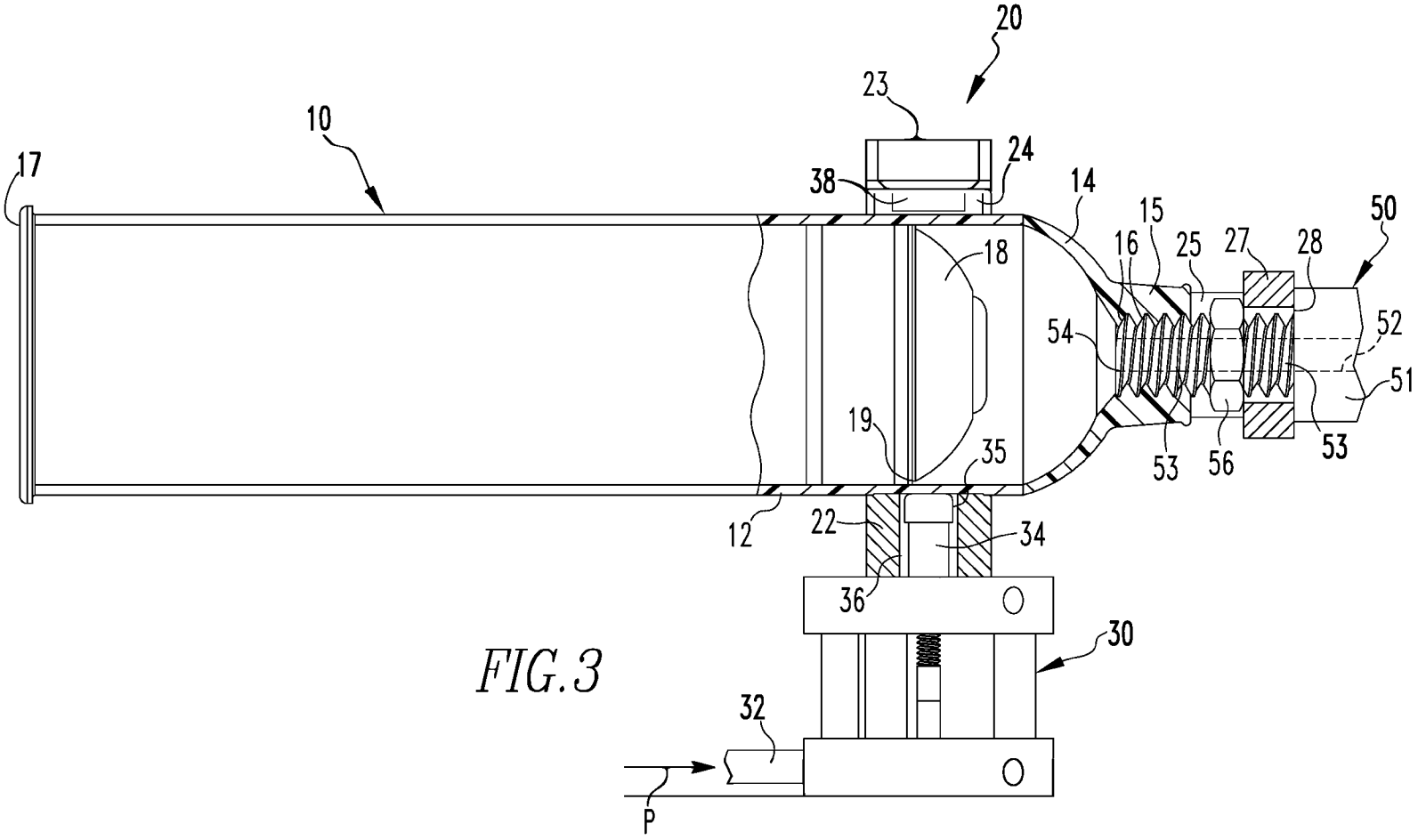
FIG. 3 is a partially broken away front view of the sealant cartridge and press fixture of FIG. 1.
Figure 4:
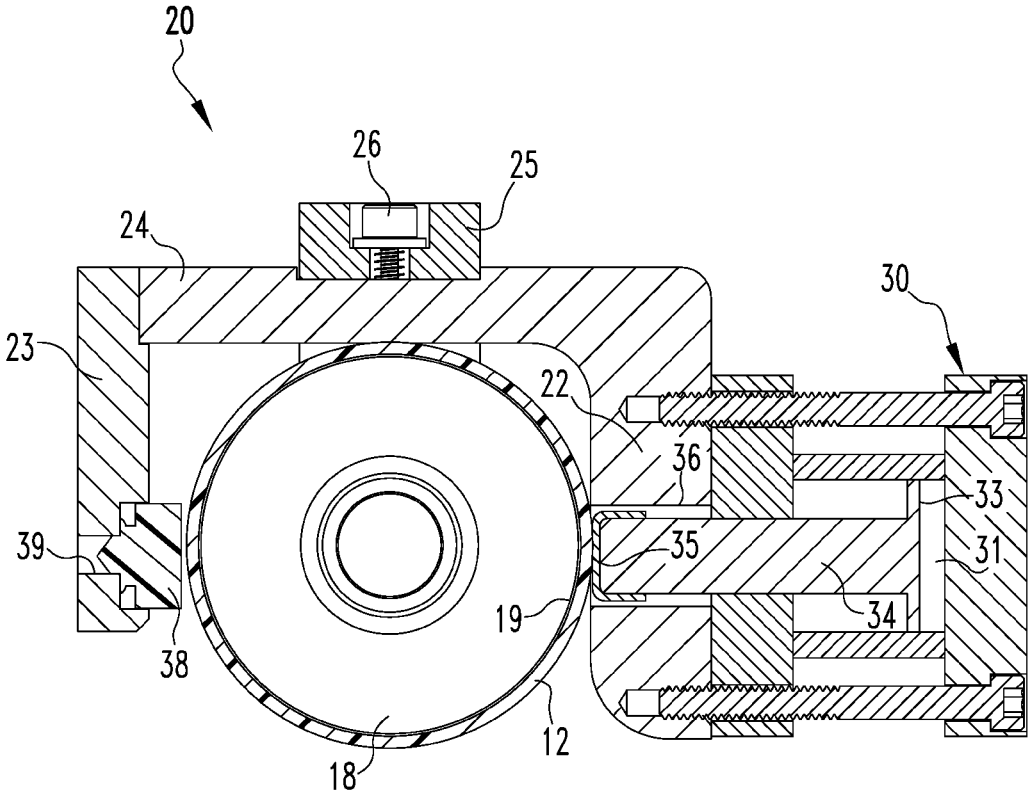
FIG. 4 is a partially schematic cross-sectional view taken through line 4-4 of FIG. 2.
Figure 5:
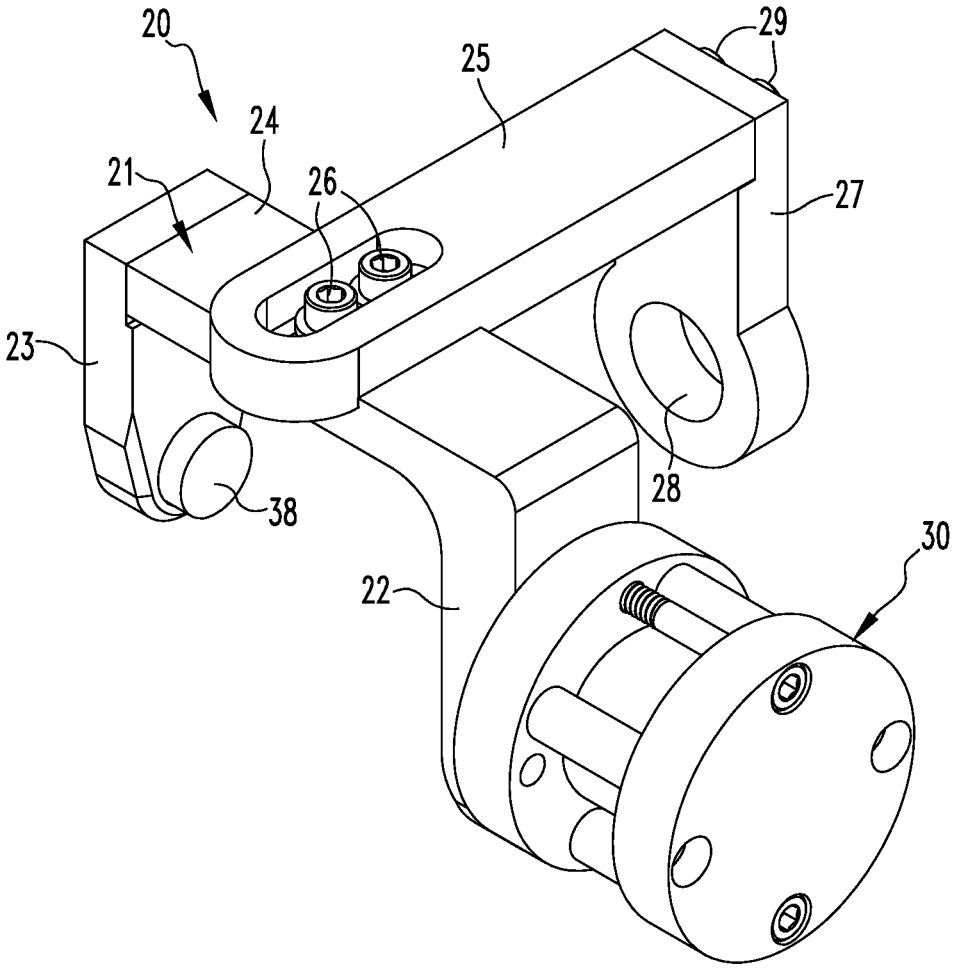
FIG. 5 is an isometric view of a press fixture of the invention.
Figure 6:
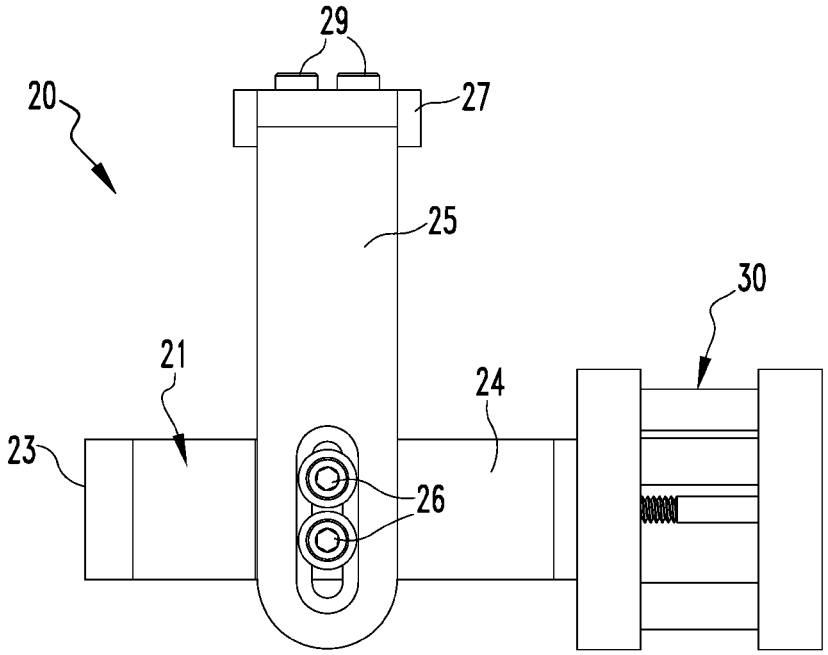
FIG. 6 is a rear view of the press fixture of FIG. 5.
Figure 7:
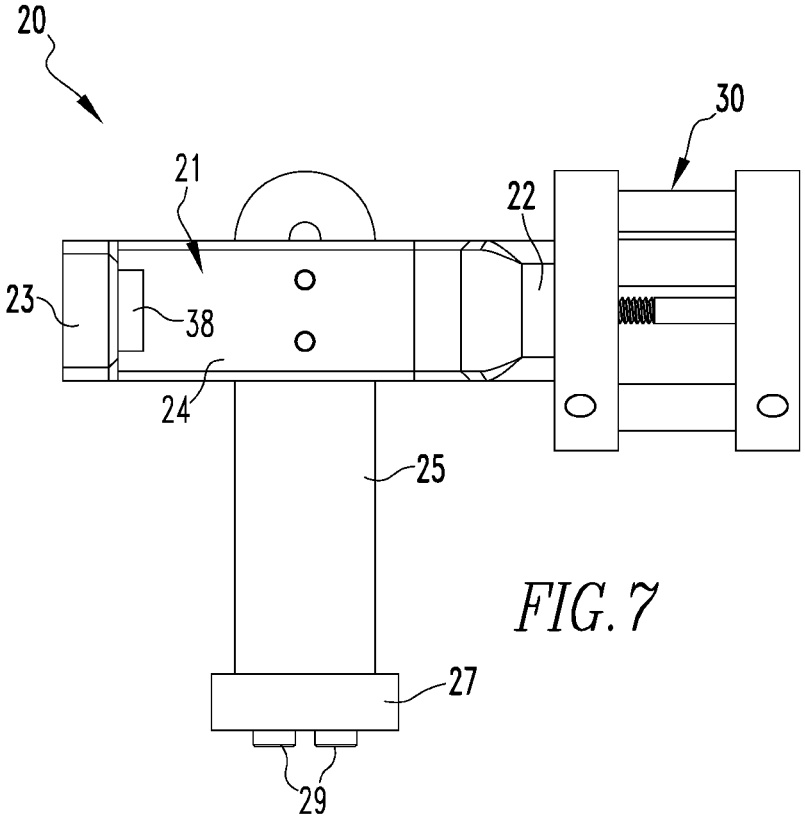
FIG. 7 is a front view of the press fixture of FIG. 5.

As shown most clearly in FIG. 3, the press fixture 20 may be releasably attached to a sealant filling nozzle 50 for delivery of uncured sealant into the sealant cartridge 10. The filling nozzle 50 includes a sealant feed tube 51 having an interior sealant feed line 52. A threaded discharge tube 53 extends from the sealant feed tube 51 and threadingly engages with the interior threads 16 of the cartridge discharge opening 15. A sealant discharge opening 54 is provided at the end of the discharge tube 53. The interior sealant feed line 52 extends through the threaded discharge tube 53 to allow sealant to flow into the interior of the sealant cartridge 10. A nut 56 is threaded onto the threaded discharge tube 53. As shown in FIG. 3, the threaded discharge tube 53 extends through the central opening 28 of the transverse support bar 27 of the press fixture 20. The nut 56 may be used to tighten the transverse support bar 27 against the sealant feed tube 51 to thereby releasably secure the press fixture 20 on the filling nozzle 50.

After the press fixture 20 is secured to the filling nozzle 50 as shown in FIG. 3, the interiorly threaded 16 discharge opening 15 of the sealant cartridge 10 may be threaded onto the threaded discharge tube 53 to thereby secure the sealant cartridge 10 in a desired filling position in relation to the filling nozzle 50. Although a threaded discharge tube 53 is shown in FIG. 3, it is to be understood that any other suitable connection may be used that adequately secures the press fixture 20 and the sealant cartridge 10 onto the filling nozzle 50. For example, the portion of the discharge tube 53 extending into the interiorly threaded discharge opening 15 of the sealant cartridge 10 may be replaced with a non-threaded cylindrical fitting that may contact or frictionally engage the interior threads 16 in order to provide a sufficient seal that prevents escape of sealant when it is dispensed from the filling nozzle 50 into the sealant cartridge 10. In this case, the mounting nut 56 may be fixed or integrally formed with the cylindrical portion of the discharge tube extending through the central opening 28 of the transverse support bar 27, and the opposite end of the discharge tube may be threaded for removable engagement with interior threads (not shown) inside the sealant feed tube 51.

Figure 8:
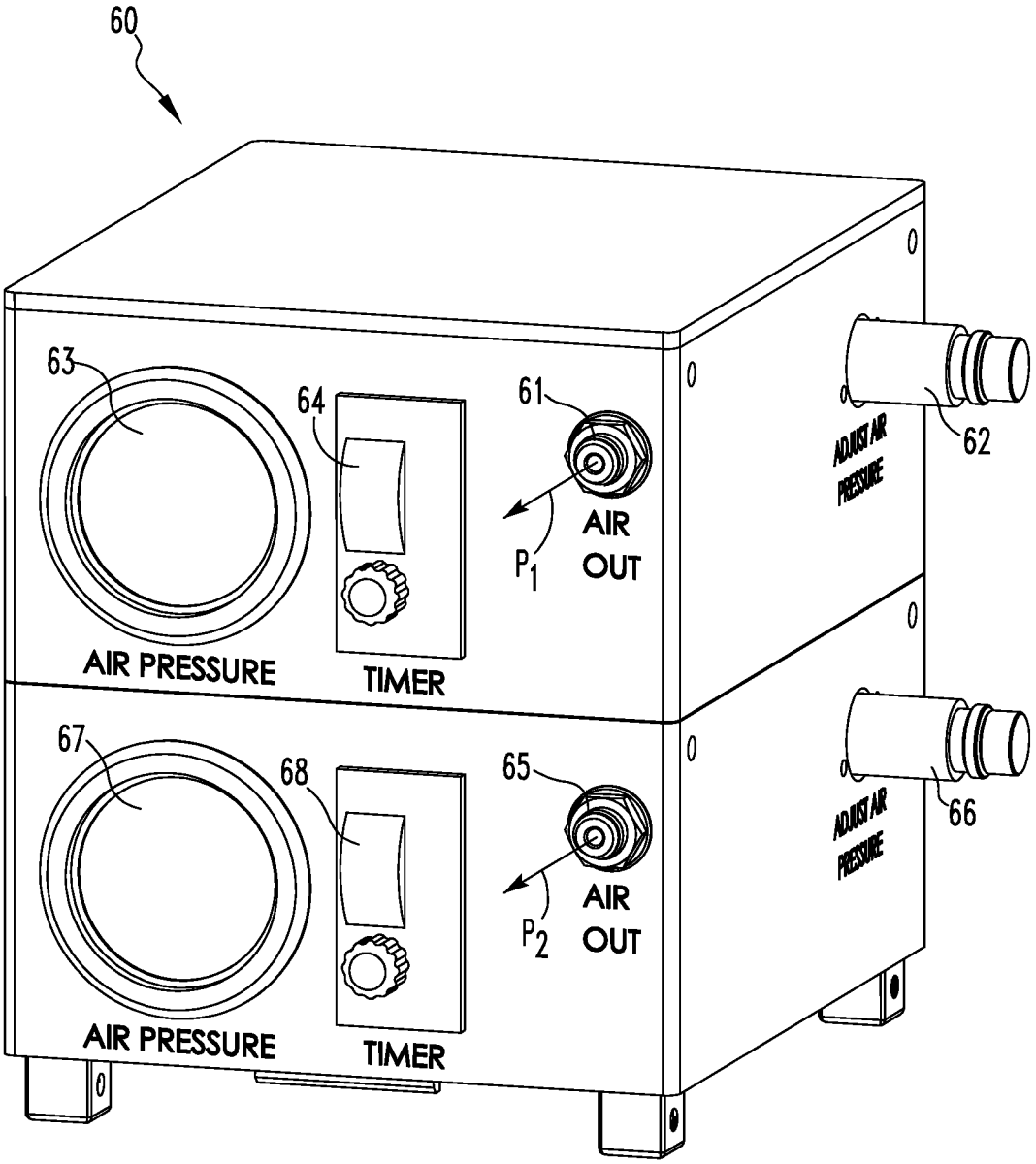
FIG. 8 is an isometric view of an air supply control unit for a press fixture of the present invention.

The air pressure cylinder 30 may be actuated by supplying pressurized air from an air supply control unit 60, as shown in FIG. 8. The air supply control unit 60 includes a first pressurized air outlet fitting 61, first pressurized air pressure regulator 62, first pressurized air pressure gauge 63, and first pressurized air pressure delivery timer 64. The air supply control unit 60 also includes a second pressurized air outlet fitting 65, second pressurized air regulator 66, second pressurized air pressure gauge 67 and second pressurized air pressure delivery timer 68. A first pressurized air flow $P_1$ may be provided from the first pressurized air outlet fitting 61 of the air supply control unit 60, and a second pressurized air flow $P_2$ may be provided from the second pressurized air pressure outlet fitting 65. In this manner, separate pressurized air flows $P_1$ and $P_2$ may be made to two separate press fixtures 20 and air pressure cylinders 30 during a sealant filing operation, as more fully described below. The air supply control unit 60 may contain pneumatic components such as the first and second pressure regulators 62 and 66, the first and second pressure gauges 63 and 67, and the first and second timers 64 and 68, with no electrical power supply needed.

The pressure regulators 62 and 66 control the level of air pressure delivered into the pressure chamber 31 of the air cylinder 30. The pressure level can be adjusted to increase or decrease the force applied by the piston rod 34 and pressure pad 35 against the sidewall 12 of the cartridge 10. The pressure gauges show the operator what the current pressure level is, e.g., measured in psi. The air pressure may typically range from 10 to 100 psi, or from 40 to 80 psi, or from 50 to 70 psi. For example, the pressure may be about 60 psi. When air pressure at such levels is supplied to the air cylinder 30, the reciprocating piston is forced outwardly from the pressure cylinder to press against and slightly deform the sidewall 12 of the sealant cartridge 10.

The piston rod 34 may typically be pressed against the cartridge sidewall 12 with a force of from 5 to 50 pounds, for example, from 10 to 30 pounds, or from 15 to 20 or 25 pounds. The force is sufficient to deform the sidewall 12 of the sealant cartridge 10 while causing less deformation of the plunger 18 that is located inside the cartridge 10. The cartridge 10 may be made of known types of polymeric materials, such as high-density polyethylene (HDPE), and the sidewall 12 is slightly deformable due to the flexibility of the polymeric material and the cylindrical geometry of the sidewall 12. The plunger 18 may also be made of the same or different type of polymeric material, but its shape, including its domed front end near the location of the pressing force of the piston rod 34 and pressure pad 35, resists deformation. Thus, the sidewall 12 is deformed slightly from its circular cross-section, but the plunger 18 substantially maintains its circular shape. In this manner, an air gap is provided between the deformed cartridge sidewall 12 and plunger 18 that allows air to escape. The air gap is sufficient to allow the escape of air, for example, a localized gap of the at least 0.2 mm may be temporarily formed, such as from 0.5 to 3 mm, or from 1 to 2 mm.

Each air delivery timer 64, 68 may determine how long the air pressure cylinder 30 is activated once the sealant filling nozzle 50 starts injecting sealant in the cartridge 10. After the timer expires, the piston 33 retracts into the air pressure cylinder 30 allowing the cartridge 10 to continue filling normally. If the timer is on too long, sealant may bypass around the plunger 18 and cause a mess. If the timer is too short, all the air is not allowed to escape. The air pressure may typically be applied at the beginning of a filling operation for at least 0.5 or 1 second, and up to 5 seconds. For example, the air pressure may be applied for from 0.5 to 3 seconds, or from 1 to 1.5 seconds. The total filling time for a sealant cartridge may typically range from 10 to 30 seconds, for example, from 12 to 20 seconds, or from 14 to 16 seconds. The air pressure may thus be applied for only a limited time during the initial stage of the filling process, for example, less than 50 percent of the filling time, or less than 15 or 20 percent of the time, or less than 5 or 10 percent of the time. The operator can adjust such air release times as necessary.

A typical procedure is as follows: the operator loads an empty cartridge (with a plunger already installed inside) onto the sealant filling machine through the neck side (small end with threads); the pressure cylinder fixture installed on the filling machine is timed to automatically squeeze the cartridge to help trapped air escape out of the cartridge during the filling process, with no operator action required, and the operator loads the cartridge on the filling machine in the normal fashion; the full cartridge is removed from the filler and a cap is placed on; and the filled cartridge is placed in the freezer for storage.

The system may include a left and right sealant filling nozzle to allow filling of two sealant cartridges to be installed on the machine. When one sealant cartridge 10 is filled, the operator may trigger a sensor on the filling machine and the other sealant cartridge 10 may begin to fill with sealant. For example, the trigger may include a standard motion detector (not shown) that senses an operator's hand movement to switch between the cartridge-filling nozzles. A dual air supply control unit 60 as shown in FIG. 8 may be used to alternately supply pressurized air to first and second press fixtures 20 during such a filling operation.

As used herein, the term "sealant" includes both sealant and adhesive formulations. Sealants useful in aerospace and other applications are often pre-mixed frozen compositions (PMF) or two-part systems. Unlike two-component systems, which require mixing the curing paste and the base before use, PMFs may be cured by external factors, such as temperature. For this reason, PMFs may be frozen at, for example, −40° F. to −80° F. in order to suppress or slow the curing reaction. When the PMFs are later brought to room temperature, the curing rate increases significantly. PMFs offer the convenience of being ready for use without mixing and therefore can be more cost- and time-effective than certain two-part systems.

As used herein, the term "one component" or "1K" refers to a composition in which all of the ingredients of the sealant may be premixed and stored at ambient conditions or optionally may be premixed and frozen and stored ("pre-mixed frozen" or "PMF" as described below), and wherein the reactive components do not readily react at stored conditions and remain "workable" for at least 10 days after mixing, but instead react only upon activation by an external energy source, under pressure, and/or under high shear force, and in the case of PMFs, thawing. External energy sources that may be used to promote curing include, for example, radiation (i.e., actinic radiation such as ultraviolet light) and/or heat. As used herein, the term "workable" means that the composition is of a viscosity that it is able to be deformed and/or shaped under manual pressure and may have a viscosity less than such viscosity.

For purposes of the description above, it is to be understood that the invention may assume various alternative variations and step sequences except where expressly specified to the contrary. Moreover, other than in any operating examples, or where otherwise indicated, all numbers expressing, for example, quantities of ingredients used in the specification and claims, are to be understood as being modified in all instances by the term "about". Accordingly, unless indicated to the contrary, the numerical parameters set forth are approximations that may vary depending upon the desired properties to be obtained by the present invention. At the very least, and not as an attempt to limit the application of the doctrine of equivalents, each numerical parameter should at least be construed in light of the number of reported significant digits and by applying ordinary rounding techniques.

It should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application, the articles "a," "an," and "the" include plural referents unless expressly and unequivocally limited to one referent.

For purposes of the detailed description, it is to be understood that the invention may assume various alternative variations and step sequences, except where expressly specified to the contrary. Moreover, other than in any operating examples, or where otherwise indicated, all numbers such as those expressing values, amounts, percentages, ranges, subranges and fractions may be read as if prefaced by the word "about," even if the term does not expressly appear. Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques. Where a closed or open-ended numerical range is described herein, all numbers, values, amounts, percentages, subranges and fractions within or encompassed by the numerical range are to be considered as being specifically included in and belonging to the original disclosure of this application as if these numbers, values, amounts, percentages, subranges and fractions had been explicitly written out in their entirety.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

As used herein, "including," "containing" and like terms are understood in the context of this application to be synonymous with "comprising" and are therefore open-ended and do not exclude the presence of additional undescribed or unrecited elements, materials, ingredients or method steps. As used herein, "consisting of" is understood in the context of this application to exclude the presence of any unspecified element, ingredient or method step. As used herein, "consisting essentially of" is understood in the context of this application to include the specified elements, materials, ingredients or method steps "and those that do not materially affect the basic and novel characteristic(s)" of what is being described.

Whereas particular embodiments of this invention have been described above for purposes of illustration, it will be evident to those skilled in the art that numerous variations of the details of the present invention may be made without departing from the invention as defined in the appended claims.

What is claimed is:

1. A sealant cartridge press fixture comprising:

a bracket comprising a first side arm and a second side arm structured and arranged to receive a sealant cartridge therebetween, and a transverse support bar connected to the first and second side arms structured and arranged for attachment to a sealant filling nozzle; and an air pressure cylinder mounted on the bracket comprising a reciprocating piston rod structured and arranged to contact and deform a sidewall of the sealant cartridge when the piston rod is extended from the air pressure cylinder.

2. The sealant cartridge press fixture of claim 1, wherein the air pressure cylinder is mounted on the first side arm of the bracket, and the piston rod extends from the air pressure cylinder in a direction toward the second side arm.

3. The sealant cartridge press fixture of claim 2, wherein the piston rod extends through a hole through the first side arm.

4. The sealant cartridge press fixture of claim 2, wherein the second side arm comprises a stationary pressure pad facing the first side arm structured and arranged to contact an opposite portion of the sidewall of the sealant cartridge when the piston rod is extended to the sidewall.

5. The sealant cartridge press fixture of claim 1, wherein the air pressure cylinder is pneumatically operated.

6. The sealant cartridge press fixture of claim 1, further comprising an air supply control unit structured and arranged to deliver pressurized air to a pressure chamber of the air pressure cylinder.

7. The sealant cartridge press fixture of claim 6, wherein the air supply control unit comprises an air pressure regulator, and air pressure gauge, and an air pressure delivery timer.

8. The sealant cartridge press fixture of claim 7, wherein the air pressure regulator, air pressure gauge and air pressure delivery timer are pneumatically operated.

9. The sealant cartridge press fixture of claim 7, wherein the air supply control unit comprises a second air pressure regulator, a second air pressure gauge, and a second air pressure delivery timer.

10. The sealant cartridge press fixture of claim 6, wherein the pressurized air delivered from the supply control unit has a pressure of from 10 to 100 psi.

11. The sealant cartridge press fixture of claim 10, wherein the pressurized air generates a pressing force of the piston rod of from 5 to 50 pounds against the sidewall of the sealant cartridge.

12. The sealant cartridge press fixture of claim 10, wherein the pressurized air is delivered for a release time period of from 0.5 to 3 seconds.

13. The sealant cartridge press fixture of claim 12, wherein the release time period is at least 50 percent less than a total filling time for filling the sealant cartridge with the sealant.

14. The sealant cartridge press fixture of claim 1, wherein the first and second side arms are connected to a cross bar extending therebetween, and the transverse support bar is connected to the cross bar by a longitudinal support bar.

15. The sealant cartridge press fixture of claim 1, wherein the transverse support bar comprises a central opening structured and arranged to receive a portion of the sealant filling nozzle therein.

16. The sealant cartridge press fixture of claim 15, wherein the sealant filling nozzle comprises a nut structured and arranged to releasably secure the transverse support bar against a sealant feed tube that is in fluid communication with the sealant filling nozzle.

17. A method of releasing trapped air from a sealant cartridge, the method comprising:

mounting an empty sealant cartridge on a sealant filling nozzle;

starting filling of the sealant cartridge with a sealant;

pressing a sidewall of the sealant cartridge to temporarily deform the sidewall to create a gap between an interior surface of the sidewall and a plunger contained within the sealant cartridge in slidable contact with the interior surface, wherein the gap allows trapped air to escape from a sealant filling region of the sealant cartridge;

stopping the pressing of the sidewall; and continuing to fill the sealant cartridge with the sealant.

18. The method of claim 17, wherein the pressing of the sidewall of the sealant cartridge is performed with a sealant cartridge press fixture of claim 1.

19. The method of claim 17, wherein the pressing of the sidewall of the sealant cartridge is performed by an air pressure cylinder comprising a piston rod that extends from the air pressure cylinder and presses against the sidewall.

20. The method of claim 19, comprising delivering pressurized air to a pressure chamber of the air pressure cylinder at an air pressure of from 10 to 100 psi.

21. The method of claim 20, wherein the air pressure is delivered for a time period of from 0.5 to 3 seconds.

22. The method of claim 19, wherein the piston rod presses against the sidewall of the sealant cartridge with a force of from 5 to 50 pounds.

23. The method of claim 19, wherein the pressing of the sidewall of the sealant cartridge is performed from 0.5 to 3 seconds.

24. The method of claim 17, wherein the pressing of the sidewall of the sealant cartridge is performed for a release time period that is at least 50 percent less than a total filling time for filling the sealant cartridge with the sealant.

* * * * *